US009498785B2

(12) United States Patent
Sakurai et al.

(10) Patent No.: US 9,498,785 B2
(45) Date of Patent: Nov. 22, 2016

(54) ELECTROSTATIC SPRAYING DEVICE

(71) Applicant: ASAHI SUNAC CORPORATION, Owariasahi-shi, Aichi (JP)

(72) Inventors: Nobuyasu Sakurai, Owariasahi (JP); Shinya Oda, Owariasahi (JP); Kenzo Yanagida, Owariasahi (JP)

(73) Assignee: ASAHI SUNAC CORPORATION, Owariasahi-shi, Aichi (JP)

( * ) Notice: Subject to any disclaimer, the term of this patent is extended or adjusted under 35 U.S.C. 154(b) by 116 days.

(21) Appl. No.: 14/378,030

(22) PCT Filed: Oct. 3, 2012

(86) PCT No.: PCT/JP2012/075653
§ 371 (c)(1),
(2) Date: Aug. 11, 2014

(87) PCT Pub. No.: WO2013/132687
PCT Pub. Date: Sep. 12, 2013

(65) Prior Publication Data

US 2015/0021419 A1 Jan. 22, 2015

(30) Foreign Application Priority Data

Mar. 6, 2012 (WO) ..... PCT/JP2012/055668

(51) Int. Cl.
*B05B 5/025* (2006.01)
*B05B 5/053* (2006.01)
*B05B 7/08* (2006.01)

(52) U.S. Cl.
CPC ..... *B05B 5/0533* (2013.01); *B05B 5/025* (2013.01); *B05B 5/053* (2013.01); *B05B 7/0815* (2013.01)

(58) Field of Classification Search
CPC ..... B05B 5/025; B05B 5/03; B05B 5/053; B05B 5/0533
See application file for complete search history.

(56) References Cited

U.S. PATENT DOCUMENTS 4,771,949 A * 9/1988 Behr ..... B05B 5/0403 239/703
5,039,019 A * 8/1991 Weinstein ..... B05B 5/0533 239/691

(Continued)

FOREIGN PATENT DOCUMENTS

JP 03-042064 2/1991
JP 04-176350 6/1992

(Continued)

OTHER PUBLICATIONS

International Search Report mailed Oct. 30, 2012, for International Patent Application No. PCT/JP2012/075653.

(Continued)

*Primary Examiner* — Ryan Reis
(74) *Attorney, Agent, or Firm* — Thomas & Karceski, PC

(57) ABSTRACT

An electrostatic spraying device includes a device body having a paint supply passage, a paint nozzle located on a distal end of the device body and having a paint flow passage communicating with the paint supply passage and a paint outlet, a high-voltage generating part configured to generate high voltage with which paint is charged, and a high-voltage electrode disposed a predetermined distance backwardly away from the paint outlet on an outer periphery of the device body, so as to be separated from the paint flow passage. The device further includes a conductor located between the high-voltage generating part and the high-voltage electrode, a spring located between the high-voltage electrode and the conductor, a high-voltage electrode case detachably attached to the device body to enclose the (Continued)

high-voltage electrode, and a grip mounted on an end of the device body, which end is located opposite the paint nozzle.

23 Claims, 18 Drawing Sheets

(56) References Cited

U.S. PATENT DOCUMENTS

| | | | | |
|---|---|---|---|---|
| 6,056,215 | A * | 5/2000 | Hansinger | B05B 3/1064 239/703 |
| 7,552,882 | B2 | 6/2009 | Matsumoto et al. | |
| 2006/0081729 | A1* | 4/2006 | Nagai | B05B 5/04 239/690.1 |
| 2008/0178802 | A1* | 7/2008 | Sakakibara | B05B 5/0533 118/621 |
| 2008/0213499 | A1* | 9/2008 | Matsumoto | B05B 5/03 427/483 |
| 2009/0140083 | A1* | 6/2009 | Seitz | B05B 5/0533 239/690.1 |

FOREIGN PATENT DOCUMENTS

| | | |
|---|---|---|
| JP | 06-134352 | 5/1994 |
| JP | 07-213958 | 8/1995 |
| JP | 2770079 | 4/1998 |
| JP | 2004-154736 | 6/2004 |
| JP | 4185351 | 9/2008 |
| JP | 2011-131121 | 7/2011 |

OTHER PUBLICATIONS

International Search Report mailed May 29, 2012, for International Patnent Application No. PCT/JP2012/055668.

* cited by examiner

ELECTROSTATIC SPRAYING DEVICE

CROSS-REFERENCE TO RELATED APPLICATION(S)

This Non-Provisional Patent Application is a National Stage Entry into the United States Patent and Trademark Office from International Patent Application No. PCT/JP2012/075653, having an international filing date of Oct. 3, 2012, which relies for priority on International Patent Application No. PCT/JP2012/055668, filed Mar. 6, 2012, the entire contents of both of which are incorporated herein by reference.

FIELD OF THE INVENTION

The present invention relates to an electrostatic spraying device configured to spray paint charged with a high voltage.

DESCRIPTION OF RELATED ART

Japanese Patent No. 2770079, Japanese Patent Application Publication No. JP-A-H07-213958, and Japanese Patent No. 4185351 disclose, as the above-mentioned type of device, an external charge type in which an electrode to which high voltage is applied for electrically charging paint is provided outside a device body and disposed ahead of a spray outlet through which the paint is sprayed. In the construction that the electrode is provided outside the device body, a paint flow passage in the device body can be normally maintained in a grounded state, with the result that the spraying device need not be switched between an insulated state and a discharge state in use thereof.

In prior art devices, such as those described above, the electrode protrudes forward from a distal end of the spray body in the construction that the electrode to which the high voltage is applied is disposed ahead of the spray outlet. Accordingly, the user needs to perform a painting operation while paying attention to prevent the electrode from contacting with an object to be painted, other devices or apparatuses, other personnel or the like. This reduces the operability of the spraying device. Further, since the electrode generates an electric field between the painted object located ahead of the spray outlet and itself, paint cannot be electrically charged intensively with the result that a charging efficiency of the paint is significantly reduced. Further, since the electrode is located ahead of a space into which the paint is sprayed from the spray outlet, there is a disadvantage that the sprayed paint tends to adhere to the electrode thereby to contaminate the same.

SUMMARY OF THE INVENTION

In order that the above-described problem may be overcome, the construction has been proposed that the electrode to which high voltage is applied is provided inside the spraying device body. According to this construction, the above-described defect in the construction of the external charge type can be overcome. However, for example, there arises another defect that the charging efficiency fluctuates thereby to become unstable depending upon a flow rate of paint-atomizing compressed air flowing in the space in which the electrode is located.

The present invention was made in view of the foregoing circumstances and an object thereof is to provide an electrostatic spraying device which can improve the operability and the charging efficiency of the paint and in which the electrode is hard to contaminate although the electrostatic spraying device is of the external charge type that the electrode to which high voltage is applied is provided outside the device body.

An electrostatic spraying device according to the invention includes a device body having a paint supply passage connected to a paint supply source, a paint nozzle provided on a distal end of device body and having a paint flow passage communicating with the paint supply passage and a paint outlet formed through a distal end of the paint flow passage, a high-voltage generating part which generates high voltage with which paint sprayed from the paint outlet is charged, and a high-voltage electrode to which the high voltage generated by the high voltage generating part is applied. The high-voltage electrode is disposed at a position a predetermined distance backwardly away from the paint outlet on an outer periphery of the device body, so as to be separated from the paint flow passage thereby to be insulated from the paint flow passage.

The device further includes a conductor provided between the high-voltage generating part and the high-voltage electrode, a spring provided between the high-voltage electrode and the conductor, a high-voltage electrode case detachably attached to the high-voltage electrode mount to enclose the high-voltage electrode, and a grip provided on an end of the device body, which end is located opposite the paint nozzle.

The electrostatic sprayer according to the invention is of an external charge type in which an electrode to which high voltage is applied for electrically charging paint is provided on an outer periphery of a device body. The high-voltage electrode is disposed to rearward of the paint outlet from which the paint is sprayed, but not ahead of the paint outlet. According to this construction, when carrying out spraying with the electrostatic spraying device, the user need not pay attention to prevent the electrode from contacting with the object to be painted, other devices or apparatuses, other personnel or the like, with the result that the operability of the electrostatic spraying device can be improved. Further, since the high-voltage electrode to which the high voltage is applied is located in the rear of the paint outlet, an electric field is hard to form between the high-voltage electrode and the object located ahead of the paint outlet. This can improve the charging efficiency of the paint. Further, since the high-voltage electrode is not located in the area into which the paint is sprayed from the paint outlet, that is, the area in front of the electrostatic spraying device, the paint sprayed from the paint outlet is hard to adhere to the high-voltage electrode. Consequently, the high-voltage electrode and accordingly an entire electrostatic spraying device become hard to soil.

BRIEF DESCRIPTION OF THE DRAWINGS

Various embodiments of the present invention will now be described in connection with the accompanying drawings, in which.

DETAILED DESCRIPTION OF EMBODIMENT(S) OF THE INVENTION

Embodiments of the invention will be described with reference to the drawings. Identical or similar parts are labeled by the same reference symbols throughout the embodiments and overlapping description will be eliminated.

A first embodiment will be described. Referring to FIGS. 1 to 4, an electrostatic spraying device 1 includes a device body 2 and a grip 3. The device body 2 is made of a non-conductive material such as an insulating synthetic resin material and composes a gun barrel of the electrostatic spraying device 1. The grip 3 is provided on a rear end of the device body 2 and functions as a gripper the user grips. The rear end of the device body 2 is located at the side opposed to the distal end thereof on which a paint nozzle 22 is mounted. The electrostatic spraying device 1 thus provided with the grip 3 is formed into a handheld electrostatic spray gun the user holds with his/her hand.

Figure 1:
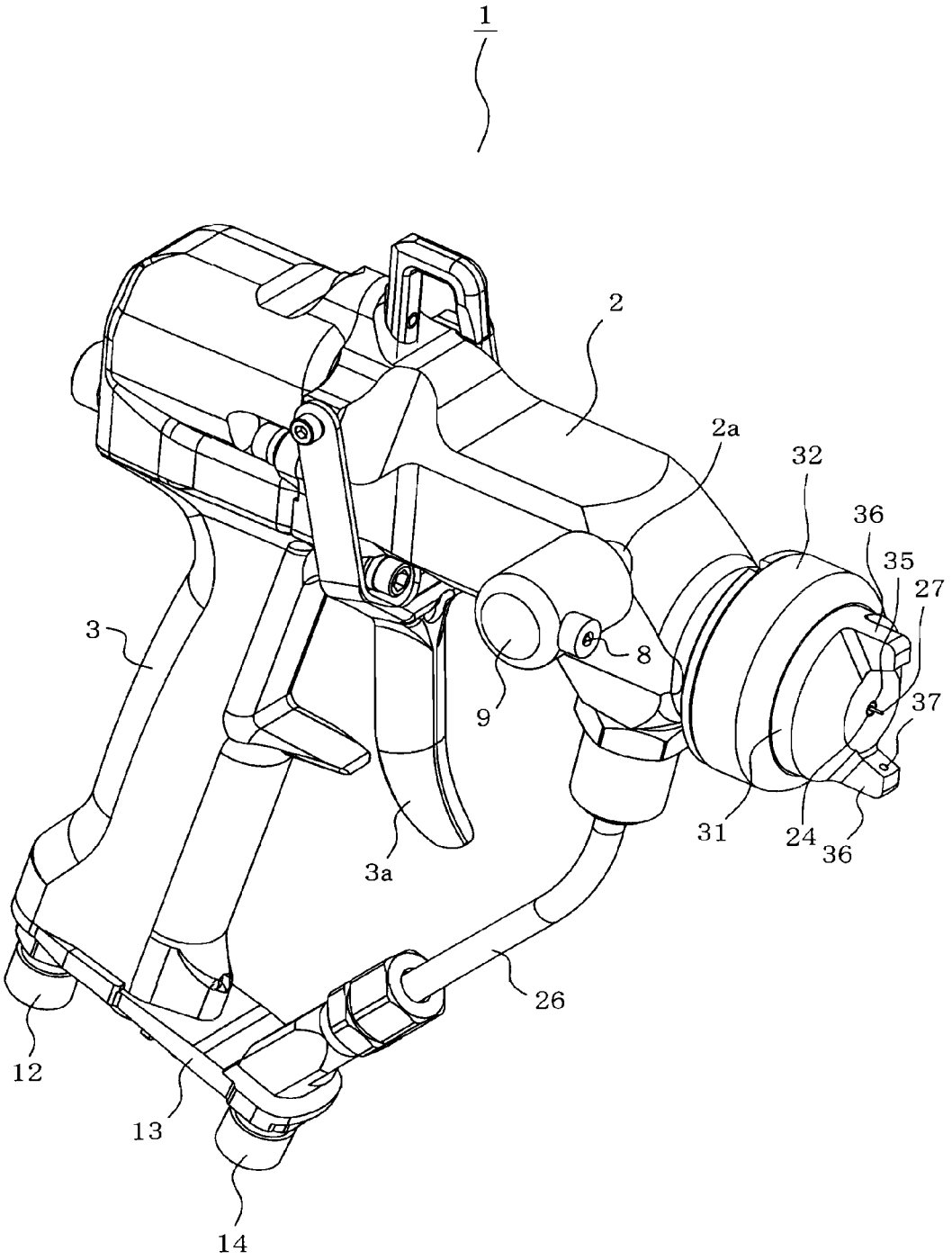
FIG. 1 is a perspective view of an electrostatic spraying device according to a first embodiment.
Figure 2:
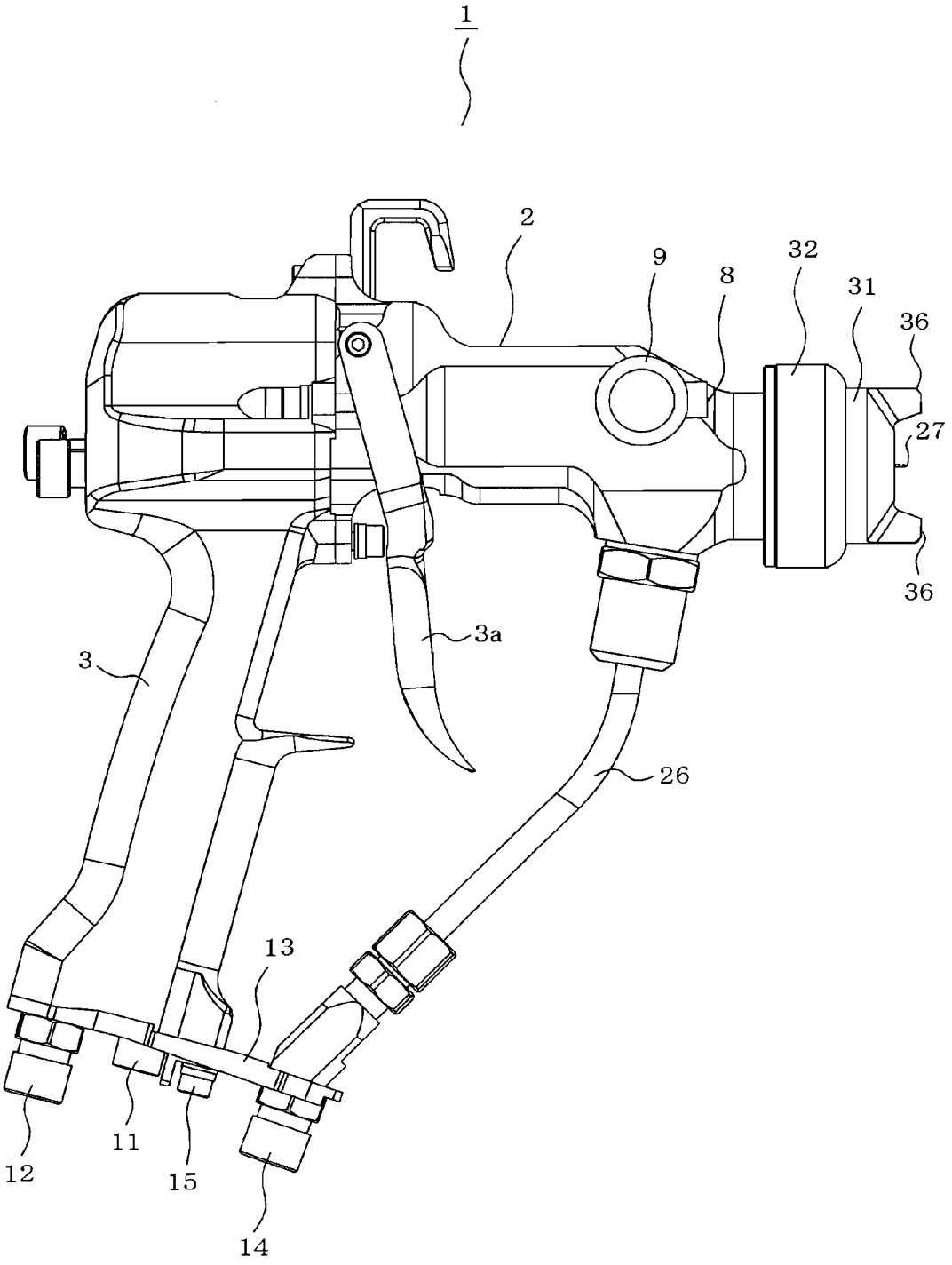
FIG. 2 is a right side view of the electrostatic spraying device.
Figure 3:
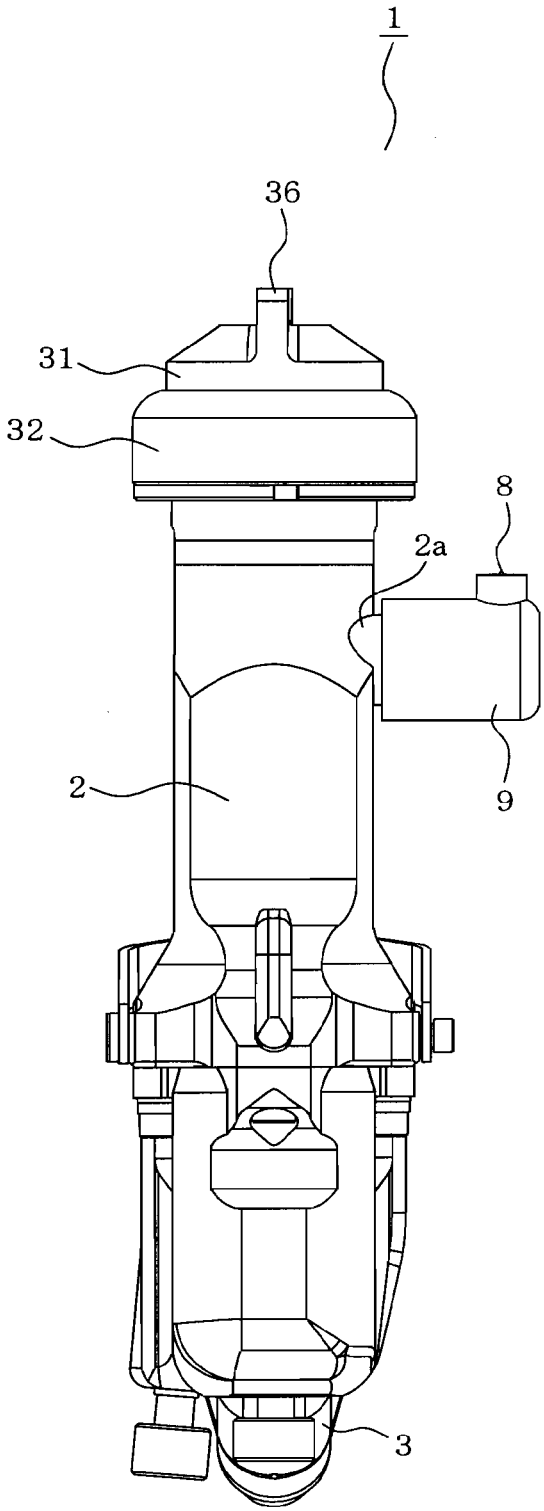
FIG. 3 is a plan view of the electrostatic spraying device.
Figure 4:
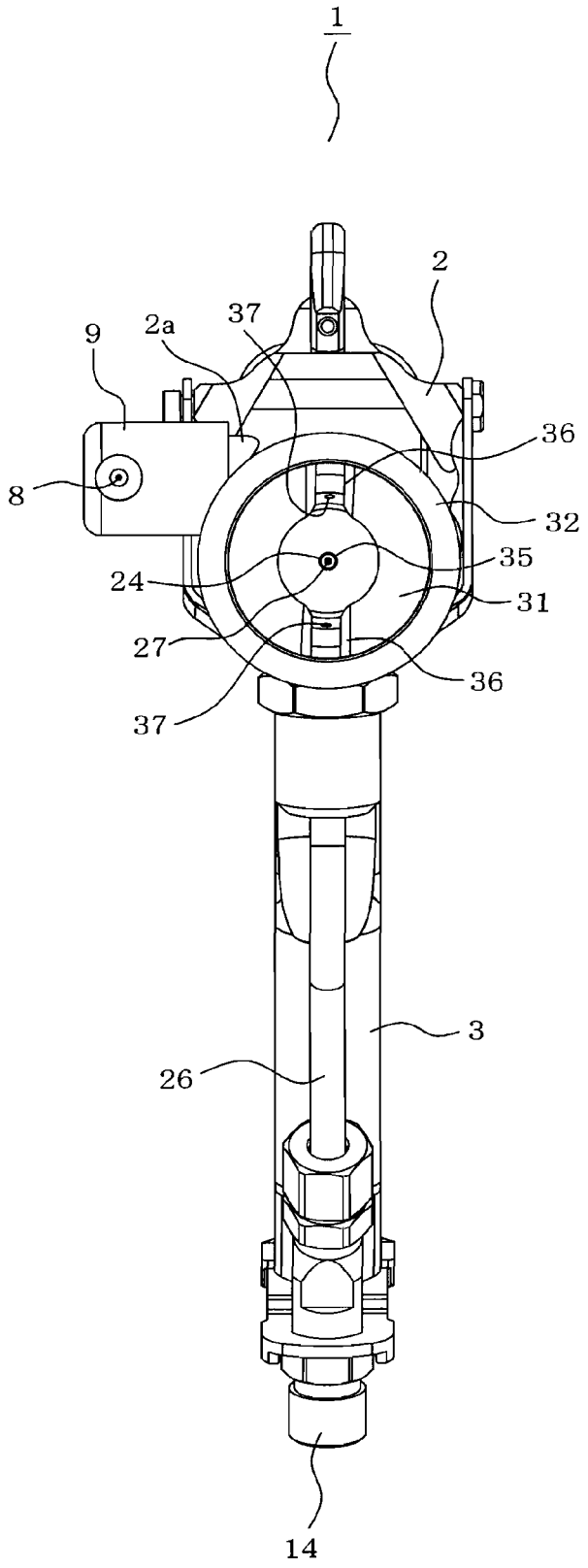
FIG. 4 is a front view of the electrostatic spraying device.
Figure 5:
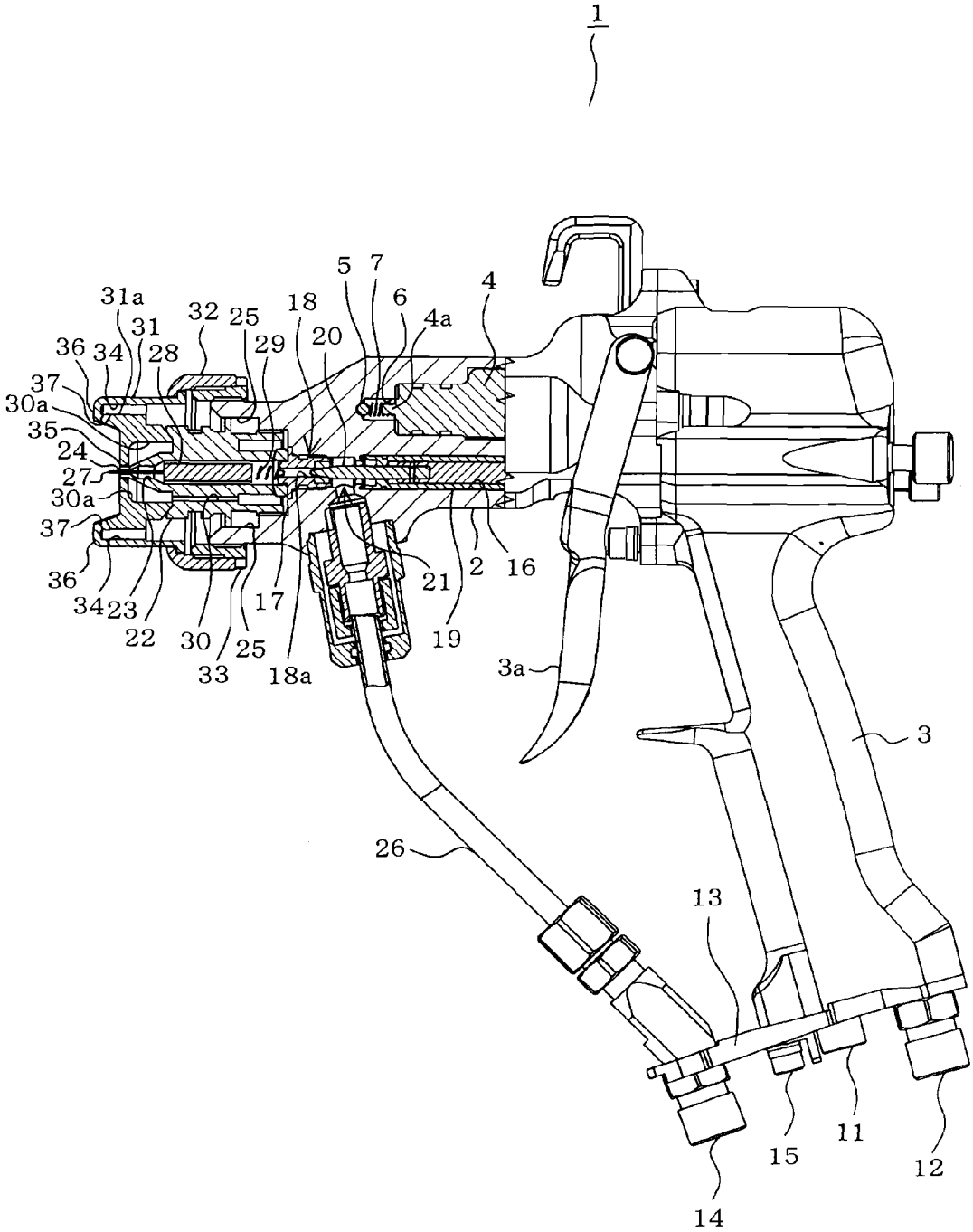
FIG. 5 is a longitudinally sectional side view of a front part of the electrostatic spraying device.
Figure 6:
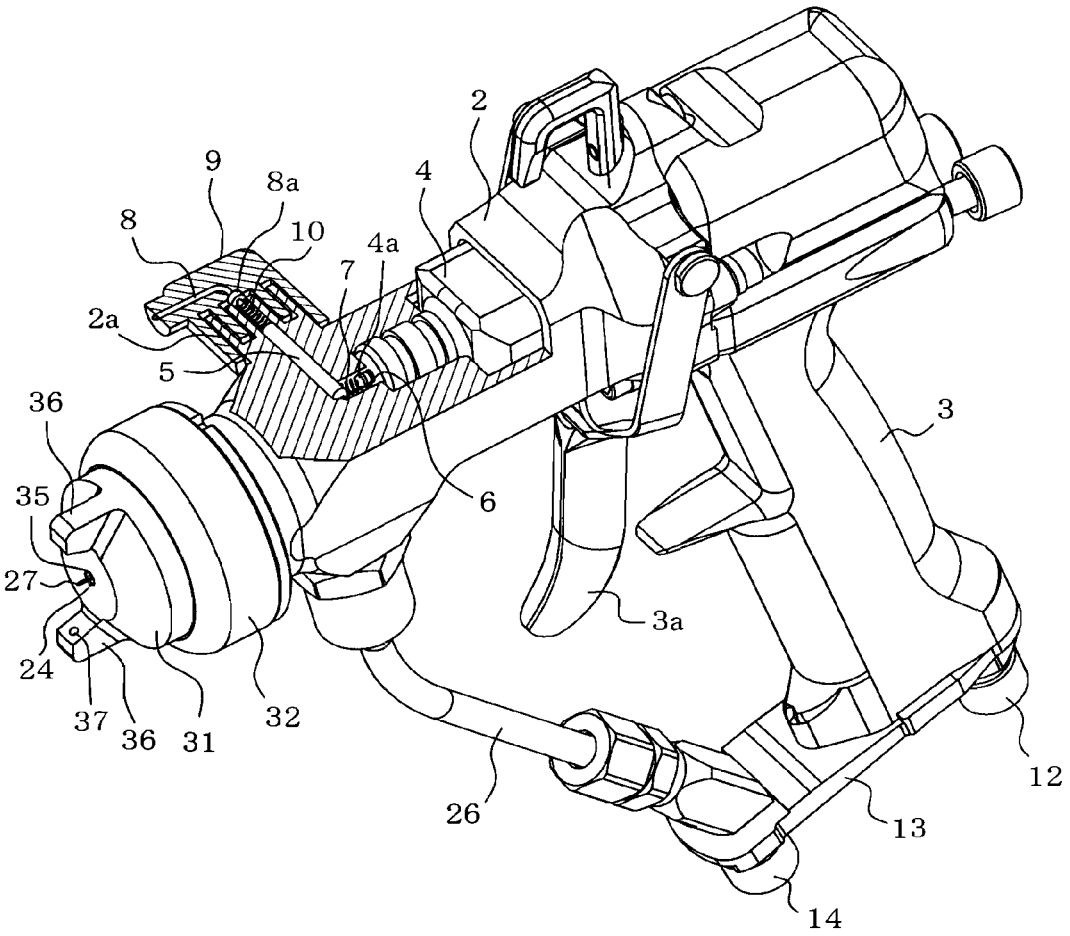
FIG. 6 is a transversely sectional perspective view of the front part of the electrostatic spraying device.

An inner structure of the electrostatic spraying device 1 will be described with reference to FIGS. 5 and 6. A high voltage generator 4 is enclosed in an upper interior of the device body 2 as shown in FIGS. 5 and 6. The high-voltage generator 4 may be a cascade type high-voltage generator molded integrally with a step-up transformer and a high-voltage rectifier circuit both composing a high-voltage generating circuit (not shown). The high-voltage generator 4 functions as a high-voltage generating part which generates a high voltage to electrically charge paint sprayed from the electrostatic spraying device 1. In this case, the high-voltage generator 4 generates a negative high voltage.

A conductor bar 5 is mounted in an inner front of the device body 2 and is a conductor as an electrically conductive member. The conductor bar 5 extends from the front of the high-voltage generator 4 in a direction perpendicular to a longitudinal direction of the device body 2, in other words, in a right-left direction of the electrostatic spraying device 1. A hole 6 is formed in front of the high-voltage generator 4 so that a proximal end of the conductor bar 5 is exposed therethrough. A spring 7 made of an electrically conductive material is enclosed in the hole 6. The spring 7 has a rear part abutting on an output terminal 4*a* located at a front end of the high-voltage generator 4 and a front part abutting on a proximal end of the conductor bar 5.

As shown in FIG. 6, a high-voltage electrode mount 2*a* protruding to the right of the device body 2 is provided on a side of the device body 2, more specifically, a right side of the device body 2 in the case where the distal end side of the device body 2 is a front. The conductor bar 5 is disposed in the high-voltage electrode mount 2*a* so that a distal end thereof extends toward the right of the device body 2. A high-voltage electrode case 9 enclosing a high-voltage electrode 8 is detachably attached to the high-voltage electrode mount 2*a*. The high-voltage electrode case 9 is made of an electrically non-conductive material such as an insulating synthetic resin material. The high voltage electrode 8 is formed into a needle shape such that a substantially entire part thereof extends in an axial direction of the device body 2. Further, the high-voltage electrode 8 has a proximal end which is bent substantially at a right angle and provided with a connection 8*a*.

The high-voltage electrode 8 is mounted on the electrostatic spraying device 1 so that a distal end thereof is oriented forward along a longitudinal direction of the electrostatic spraying device 1 and so that the connection 8*a* of the proximal end thereof is oriented to the device body 2 side, in this case, leftward. A spring 10 made of an electrically conductive material is enclosed between the connection 8*a* of the high-voltage electrode 8 and the distal end of the conductor bar 5. As a result, the conductor bar 5 and the high-voltage electrode 8 are connected to each other physically and electrically.

A power-supply connector 11 and an air hose joint 12 are mounted on an underside of the grip 3. Further, a cylindrical paint hose joint 14 is also connected via a connecting member 13 to the underside of the grip 3. The connecting member 13 is fixed to a lower end of the grip 3 by a screw 15. Each of the connecting member 13 and the screw 15 is made of an electrically conductive material. Further, a ground wire (not shown) provided in the power-supply connector 11 and the paint hose joint 14 are electrically connected to each other via the connecting member 13 and a lead wire (not shown) connected to the connecting member 13. Accordingly, the paint hose joint 14 is grounded through the ground wire of the power-supply connector 11.

A high-frequency voltage necessary for generation of high voltage is taken in from the power-supply connector 11 on the lower part of the grip 3 thereby to be supplied through a distribution cable (not shown) inside the grip 3 to the step-up transformer of the high-voltage generator 4. The supplied high-frequency voltage is stepped up by the step-up transformer and is further stepped up and rectified by a high-voltage rectifier circuit employing a Cockcroft-Walton voltage doubler rectifier circuit, whereby the negative DC high voltage of several tens of thousands volts is generated. The DC high voltage generated by the high voltage generator 4 is led from an output terminal 4*a* via the spring 7 to the conductor bar 5 to be supplied via the conductor bar 5 and the spring 10 to the high-voltage electrode 8. As a result, the negative high voltage is applied to the high-voltage electrode 8.

A hole 16 extending in the front-back direction is formed in a lower inside of the device body 2 as shown in FIG. 5.

Further, a mounting recess 17 is formed in a front end of the device body 2. The mounting recess 17 has a rear end surface in which the hole 16 is open. A paint valve 18 is provided in a front interior of the hole 16. Further, a hollow guide member 19 is provided in the rear of the paint valve 18 in the hole 16 with a space being defined therebetween. The paint valve 18 has a valve orifice 18*a* axially extending through the conductive valve body. The valve orifice 18*a* is opened and closed by a needle 20.

The hole 16 includes a space which is defined between the paint valve 18 and the guide member 19 and serves as a valve chest 21. The needle 20 extends through the valve chest 21 and has a front end formed into a tapered shape. The needle 20 has a rear part inserted through the front end of the needle 20 thereby to be movable in the front-back direction along the guide member 19. The paint valve 18 is closed when a front end of the needle 20 abuts on the valve orifice 18*a*. The paint valve 18 is opened when the front end of the needle 20 is caused to depart from the valve orifice 18*a*.

The needle 20 is normally biased by a return spring (not shown) in a direction such that the valve orifice 18*a* is normally closed, in this case, forward with respect to the electrostatic spraying device 1. Only while a trigger 3*a* mounted on the device body 2 is pulled to the grip 3 side, the needle 20 is moved backward against a return spring. Consequently, the valve orifice 18*a* departs from the front end of the needle 20 with the result that the paint valve 18 is opened.

A rear half of the mounting recess 17 has a smaller diameter than a front half of the mounting recess 17. A paint nozzle 22 is detachably attached to the smaller diameter portion. The paint nozzle 22 is made of an insulating synthetic resin material and the front half thereof protrudes ahead of the mounting recess 17. A paint passage 23 is formed in a central part of the paint nozzle 22 so as to extend through the paint nozzle 22. The paint nozzle 22 has a front end including a part which is a front end of the paint passage 23 and has a smaller diameter. The part serves as a paint outlet 24. When the paint nozzle 22 is attached to the mounting recess 17, an annular space is defined around the paint nozzle 22. The annular space is used as a pattern air flow passage 25.

In the electrostatic spraying device 1 as constructed above, for example, paint in an external paint supply source (not shown) including a paint tank is supplied via an electrically non-conductive paint hose (not shown) to the paint hose joint 14 and led through the paint tube 26 into the valve orifice 18*a*. When the trigger 3*a* is in a non-operated state, the paint led into the valve orifice 18*a* is prevented from being discharged into the paint nozzle 22 by the needle 20 closing the valve orifice 18*a*. On the other hand, when the trigger 3*a* is operated to open the paint valve 18, the paint supplied into the valve orifice 18*a* is discharged into the paint flow passage 23 in the paint nozzle 22. In this case, a paint supply passage is comprised of the paint hose joint 14, the paint tube 26 and the valve chest 21. Further, as described above, the paint hose joint 14 is connected via a ground wire of the power supply connector 11 so as to be maintained at a ground potential. Accordingly, the paint flowing in the paint supply passage while passing through the paint hose joint 14 is maintained at the ground potential. The paint used with the electrostatic spraying device 1 is a water-based paint or a metal-based paint each of which has a relatively lower electrical resistance. A water-based paint or a metal-based paint, each of which has a relatively lower electrical resistance, is suitable for the paint used with the electrostatic spraying device 1 but not a solvent-based paint having a relatively higher electrical resistance.

A pin-shaped ground electrode 27 is inserted through the paint passage 23. The ground electrode 27 has a front end which extends through the paint outlet 24 to protrude ahead of the paint outlet 24. The ground electrode 27 includes a rear half held in a holding member 28 made of a non-conductive material. The ground electrode 27 may or may not protrude ahead of a corner 36 which will be described later. An electrically conductive spring 29 is enclosed in a rear part of the holding member 28 in the paint passage 23. The spring 29 has a rear end abutting on the front end of the paint valve 18. Thus, the ground electrode 27 and the paint valve 18 are connected via the spring 29 to each other physically and electrically.

A plurality of atomization air flow passages 30 is formed in a part of the paint nozzle 22 interior around the paint flow passage 23. The atomization air flow passages 30 have respective front ends communicating with an annular atomization air flow passage 30*a* provided in a front end of the paint nozzle 22.

An air valve (not shown) is provided on a rear end of the device body 2. An air flow passage (not shown) is provided in the grip 3 to interconnect the air hose joint 12 and the air valve. Compressed air for atomization air and pattern air is supplied from an external compressed air generator (not shown) through a high-pressure air hose to the air hose joint 12 thereby to be led through the air flow passage to the air valve. The air valve is opened and closed by a valving element (not shown) moved back and forth together with the needle 20. More specifically, the air valve is opened when the paint valve 18 is opened. The air valve is closed when the paint valve 18 is closed. When the air valve is opened, compressed air is supplied through an atomization air supply passage (not shown) and a pattern air supply passage (not shown) to the pattern air flow passage 25 and the atomization air flow passage 30 of the paint nozzle 22. Both of the atomization air supply passage and the pattern air supply passage are provided in the device body 2.

The front end of the paint nozzle 22 is covered with an air cap 31 attached to the front end of the device body 2. The air cap 31 is made of an insulating resin such as polyacetal. The air cap 31 includes a central rear surface provided with a fitting protrusion 31*a* which is fitted with the front end of the paint nozzle 22. The air cap 31 is fixed via an annular retaining nut 32 and an annular fixing member 33 to the front end of the device body 2. The retaining nut 32 and the fixing member 33 are made of an insulating resin such as polyacetal.

After the paint nozzle 22 has been inserted into the mounting recess 17, the air cap 31 is fitted with the front end of the paint nozzle 22, and the fixing member 33 and the retaining nut 32 are inserted from the front end of the air cap 31 to be screwed with the air cap 31 thereby to be fixed to the device body 2 together with the air cap 31. In this case, an annular space is defined between the air cap 31 and the device body 2 so as to be located around the paint nozzle 22. The space serves as the pattern air flow passage 25 and the pattern air flow passage 34.

The air cap 31 has an atomization air outlet 35 formed through a central part thereof. The paint nozzle 22 has a paint outlet 24 which is inserted through the atomization air outlet 35. The atomization air outlet 35 communicates with the atomization air flow passage 30*a*, so that atomization air supplied into the atomization air flow passage 30*a* is spouted forward through an annular gap between an inner periphery of the atomization air outlet 35 and an outer periphery of the paint outlet 24.

Further, the front end of the air cap 31 includes upper and lower portions between which the atomization air outlet 35 is sandwiched and which are formed with a pair of protrusions 36 protruding forward, respectively. Each protrusion 36 is formed with a plurality of pattern air outlets 37 communicating with the pattern air flow passage 34. The pattern air outlets 37 are inclined diagonally forward toward a central axis of the air cap 31. Accordingly, pattern air serving as compressed air supplied into the pattern air flow passage 34 is spouted diagonally forward from the pattern air outlet 37. The protrusions 36 protrude ahead of the ground electrode 27 in this case. However, when an air cap having no protrusions or an air cap having shorter protrusions is used, the ground electrode 27 protrudes forward from the front of the air cap.

In the electrostatic spraying device 1 as constructed above, the high-voltage electrode 8 is provided on an outer periphery of the device body 2, that is, a right part of the spraying device 1 (a right area). In this case, the distal end of the high-voltage electrode 8 is disposed at a position a predetermined distance L backwardly away from the paint outlet 24. The high-voltage electrode 8 extends forward from the high-voltage electrode mounting portion 2*a* to the position the predetermined distance L backwardly away from the distal end of the ground electrode 27 but does not extend further. In other words, the distal end of the high-voltage electrode 8 does not protrude ahead of the distal end of the ground electrode 27 and a distal end of the entire electrostatic spraying device 1 (distal ends of the protrusions 36, in this case).

The high-voltage electrode 8 is located in a side region of the electrostatic spraying device 1 in its entirety, and an entire or a part of the high-voltage electrode 8 is not located in a region in front of the electrostatic spraying device 1. Further, the high-voltage electrode 8 disposed on an outer periphery of the device body 2 extends forward or in a spraying direction of the paint and has a distal end which does not protrude ahead of the distal end of the ground electrode 27 and further ahead of the distal end of the electrostatic spraying device 1. More specifically, the high-voltage electrode 8 is shorter than the device body 2 in an entire length and is located in the side region of the electrostatic spraying device 1 in its entirety.

Further, the high-voltage electrode 8 is covered, in its entirety, with the high-voltage electrode case 9 made of the insulating material. Moreover, the conductor bar 5 and the springs 7 and 10 all electrically connected to the high-voltage electrode 8 are also covered with the device body 2 made of the insulating material. Accordingly, the high-voltage electrode 8 is disposed separately from the paint flow passage 23 in the device body 2 so as to be electrically insulated from the paint flow passage 23. Further, the high-voltage electrode 8 is disposed at a position which is a predetermined distance H radially outward away from the paint flow passage with a central focus on a spray axis S connecting between the paint outlet 24 and an object to which the paint sprayed from the paint outlet 24 is caused to adhere, by a most direct way. More specifically, the high-voltage electrode 8 is separated from the spray axis S with the insulating member being interposed therebetween and is further separated from a side of the device body 2, in other words, a side of the electrostatic spraying device 1 with the insulating member being interposed therebetween.

The operation of the electrostatic spraying device 1 thus constructed will now be described. When the trigger 3*a* is pulled to the grip 3 side, the paint valve 18 is opened with the result that the paint supplied from the paint hose joint 14 is discharged to the paint flow passage 23. The paint is discharged in the form of a membrane from the paint outlet 24 in the front end of the paint nozzle 22 down the surface of the ground electrode 27. Further, compressed air is supplied to the atomization air flow passage 30, so that the compressed air is sprayed forward as atomization air through the narrow gap between the inner periphery of the atomization air outlet 35 and the outer periphery of the paint outlet 24. As a result, the paint discharged from the paint outlet 24 down to the surface of the ground electrode 27 is atomized by the atomization air.

When the trigger 3*a* is pulled to the grip 3 side, high frequency voltage is supplied to a high-voltage generating circuit of the high-voltage generator 4. A negative DC high voltage of tens of thousands of volts generated by the high-voltage rectifier circuit is led from the output terminal 4*a* via the spring 7, the conductor bar 5 and the spring 10 to the high-voltage electrode 8. On the other hand, the ground electrode 27 is brought into contact with the paint passing through the grounded paint hose joint 14 and supplied through the paint tube 26 and the paint valve 18 into the paint nozzle 22, namely, the paint maintained at the ground potential, with the result that the ground electrode 27 is maintained at the ground potential. Accordingly, a strong electric field (electric line of force) is generated between the high-voltage electrode 8 to which the negative high voltage is applied and the ground electrode 27 which is maintained at the ground potential with the result that a corona discharge field occurs, whereby paint particles discharged from the paint outlet 24 and atomized rush out in front of the electrostatic spraying device 1 in the charged state.

Figure 8:
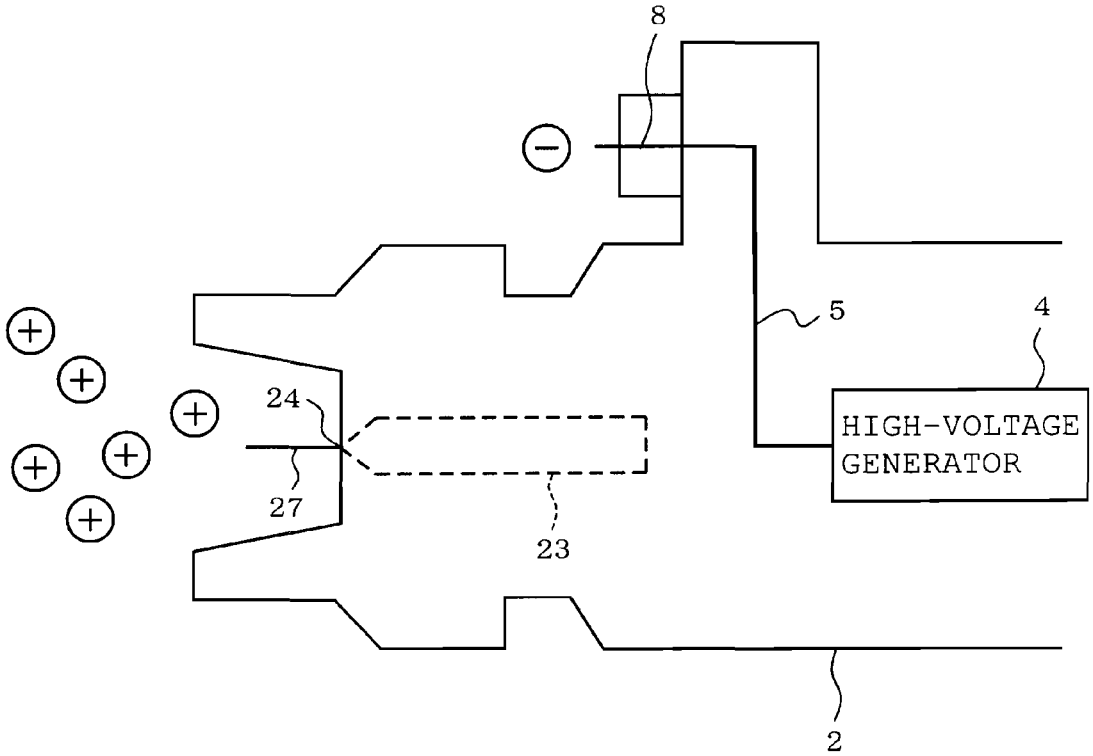
FIG. 8 is a view explaining a manner of charging paint particles by the electrostatic spraying device.

A manner of electrically charging paint particles by the electrostatic spraying device 1 will now be described in more detail with reference to FIG. 8. In the electrostatic spraying device 1, the high-voltage electrode 8 is disposed on the outer periphery of the device body 2 in the rear of the paint outlet 24 with a sufficient distance therebetween. The negative high voltage is applied to the high-voltage electrode 8 disposed as described above. On the other hand, the ground electrode 27 protruding from the paint outlet 24 is maintained at the ground potential. According to this charging manner, the paint particles sprayed from the paint outlet 24 while contacting the ground electrode 27 are positively charged whereas the high-voltage electrode 8 is negatively charged. More specifically, in the manner of charging the paint particles by the electrostatic spraying device 1, the polarity of voltage applied to the high-voltage electrode 8 is opposite to the polarity of the charged paint particles. This charging manner is referred to as "indirect charging manner."

Further, according to the electrostatic spraying device 1, the high-voltage electrode 8 is also disposed with a sufficient distance from the ground electrode 27 with respect to the radial direction of the device body 2. Accordingly, a sufficient distance can be ensured between the positively charged paint particles sprayed from the paint outlet 24 and the negatively charged high-voltage electrode 8. This can prevent the charged paint particles from being attracted to the device body 2 side.

Existing techniques will now be described as supplemental. A first technique relates to a construction which employs an external changing manner and in which the high-voltage electrode extends ahead of the paint outlet. In the construction, paint particles sprayed out of the paint outlet are electrically charged by an electric field generated between the high-voltage electrode and the object to be painted. Accordingly, the charged paint particles have the same polarity as the voltage applied to the high-voltage electrode. More specifically, this existing technique clearly differs in the principle of charging the paint particles from the electrostatic spraying device 1 of the embodiment in which the polarity of voltage applied to the high-voltage electrode 8 is opposite to the polarity of the charged paint particles.

Further, a second existing technique relates to a construction in which the high-voltage electrode is provided inside the device body, that is, the construction generally referred to as the indirect charging manner. In this existing technique, a large amount of negative ion generated by the high-voltage electrode or a floating electrode adheres to a surface of the distal end of the device body (the air cap), with the result that positively charged paint particles are attracted by the negative ion. Accordingly, since the distal end of the apparatus is particularly apt to be soiled by the paint particles, the second existing technique cannot achieve the same effect as the electrostatic spraying device 1 of the embodiment.

The manners of charging the paint particles have been described above. The operation of the electrostatic spraying device 1 will now be described again. A spray pattern of the paint particles rushing ahead of the electrostatic spraying device 1 as described above is formed into a shape suitable to painting, for example, an elliptical or oval shape.

The paint particles are fed with the pattern air to the vicinity of the object. When the electrically charged paint particles come close to the object, electrostatic induction causes an electric charge on the surface of the grounded object. The caused charge has a polarity opposite to that of the paint particles. Consequently, an electrostatic force acts between the paint particles and the object with the result that the paint particles are subjected to an attractive force passing toward the object. More specifically, the paint particles are caused to adhere to the surface of the object by both the attractive force and a spraying force of the pattern air. Since the attractive force due to the electrostatic force acts, the paint particles are caused to move around to the object's back side not facing the electrostatic spraying device 1, thereby also adhering to the back. The object is electrostatically painted by the above-described action.

Figure 7:
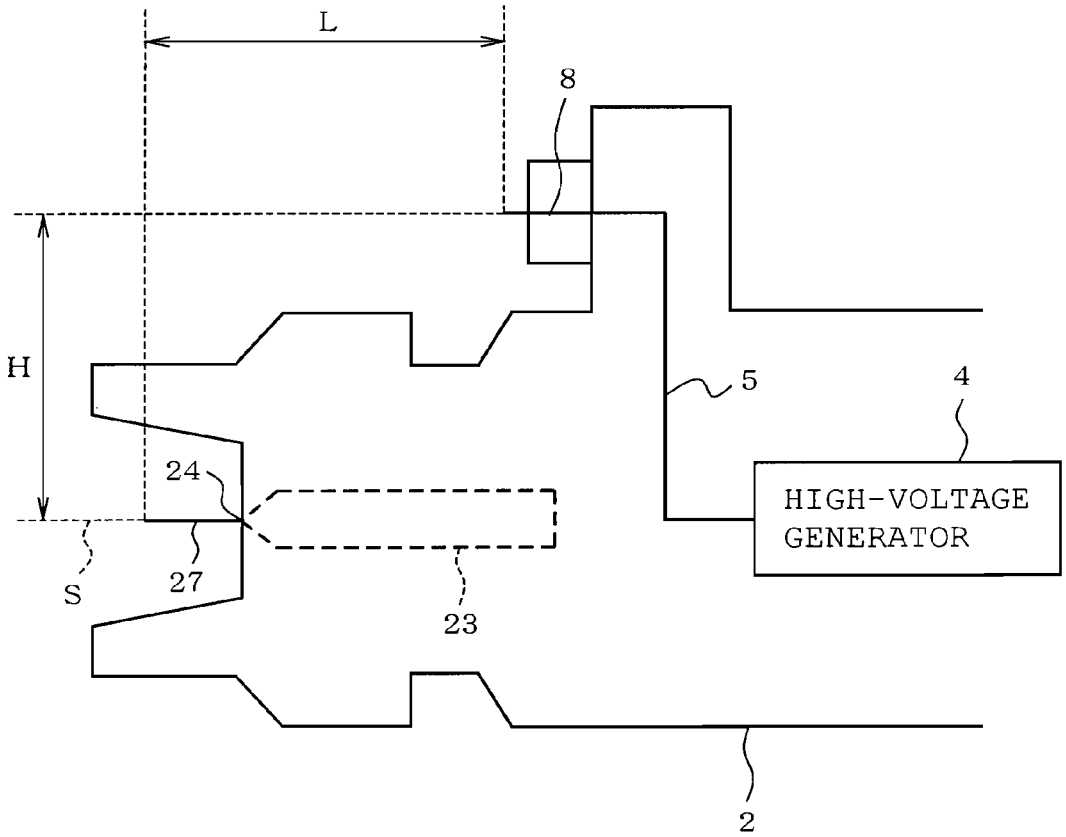
FIG. 7 is a schematic view showing a distance between a distal end of high-voltage electrode and a distal end of ground electrode and a distance between a central axis of the high-voltage electrode and a central axis of the ground electrode.

The following describes results of an experiment conducted by the inventors with respect to the electrostatic spraying device 1 having the above-described construction. The experiment was conducted to examine the relationship between distance L and distance H shown in FIG. 7 and an electric charge amount (μC/g) of the paint particles. Distance L refers to a distance between the distal end of the high-voltage electrode 8 and the distal end of the ground electrode 27 protruding from the paint outlet 24. Distance H refers to a distance between the central axis of the high-voltage electrode 8 and the spray axis S, in other words, a distance between the central axis of the high-voltage electrode 8 and the central axis of the ground electrode 27 inserted through the paint outlet 24 and the paint passage 23.

Figure 9:
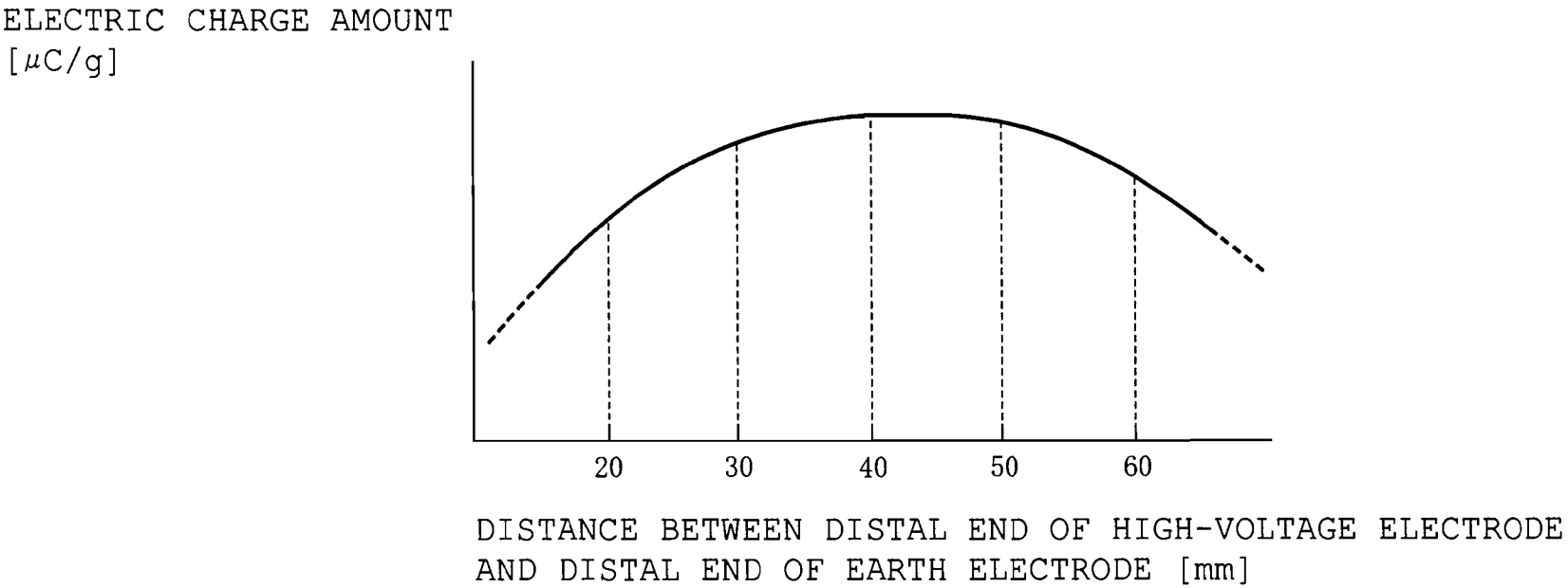
FIG. 9 is a graph showing the relationship between the distance between the distal ends of the high-voltage electrode and the ground electrode and an electric charge amount of paint particles.
Figure 10:
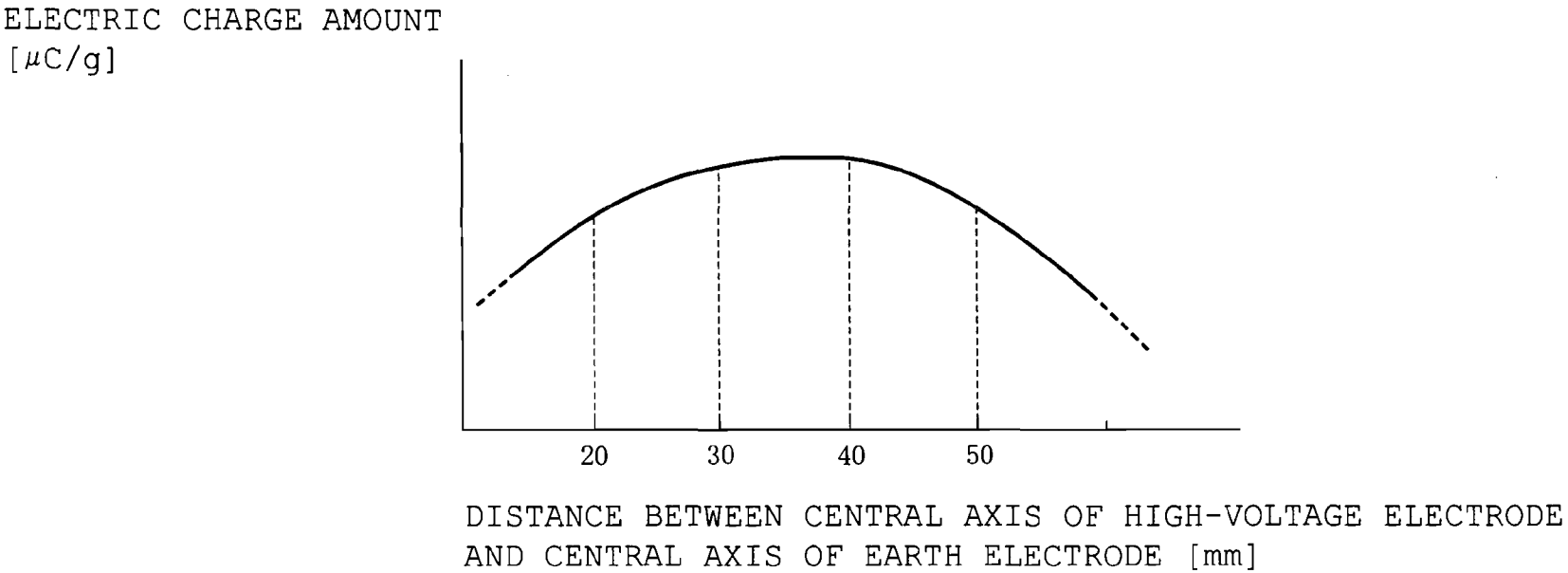
FIG. 10 is a graph showing the relationship between the distance between the central axes of the high-voltage electrode and the ground electrode and an electric charge amount of paint particles.
Figure 11:
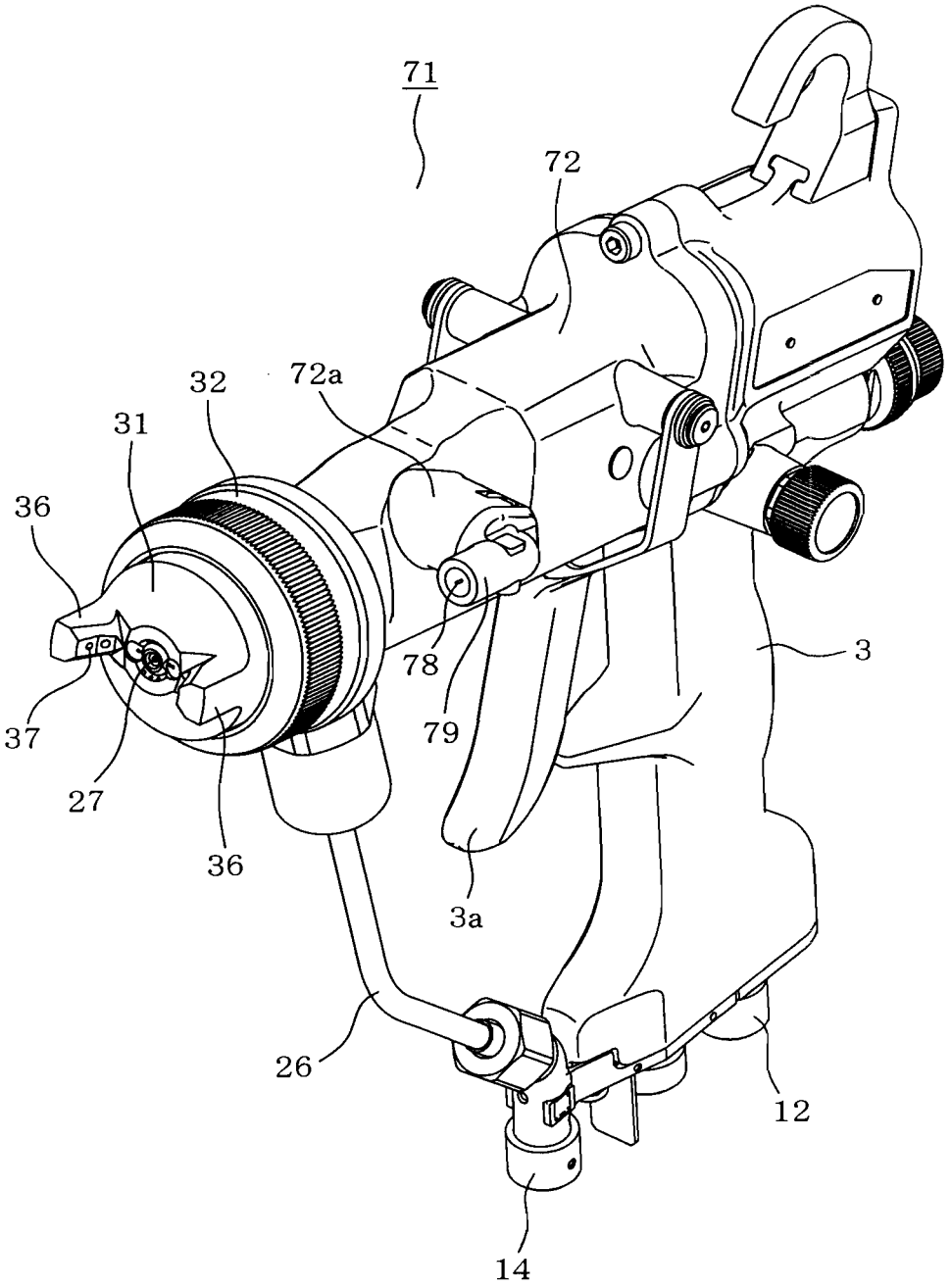
FIG. 11 is a perspective view of the electrostatic spraying device according to a second embodiment.
Figure 12:
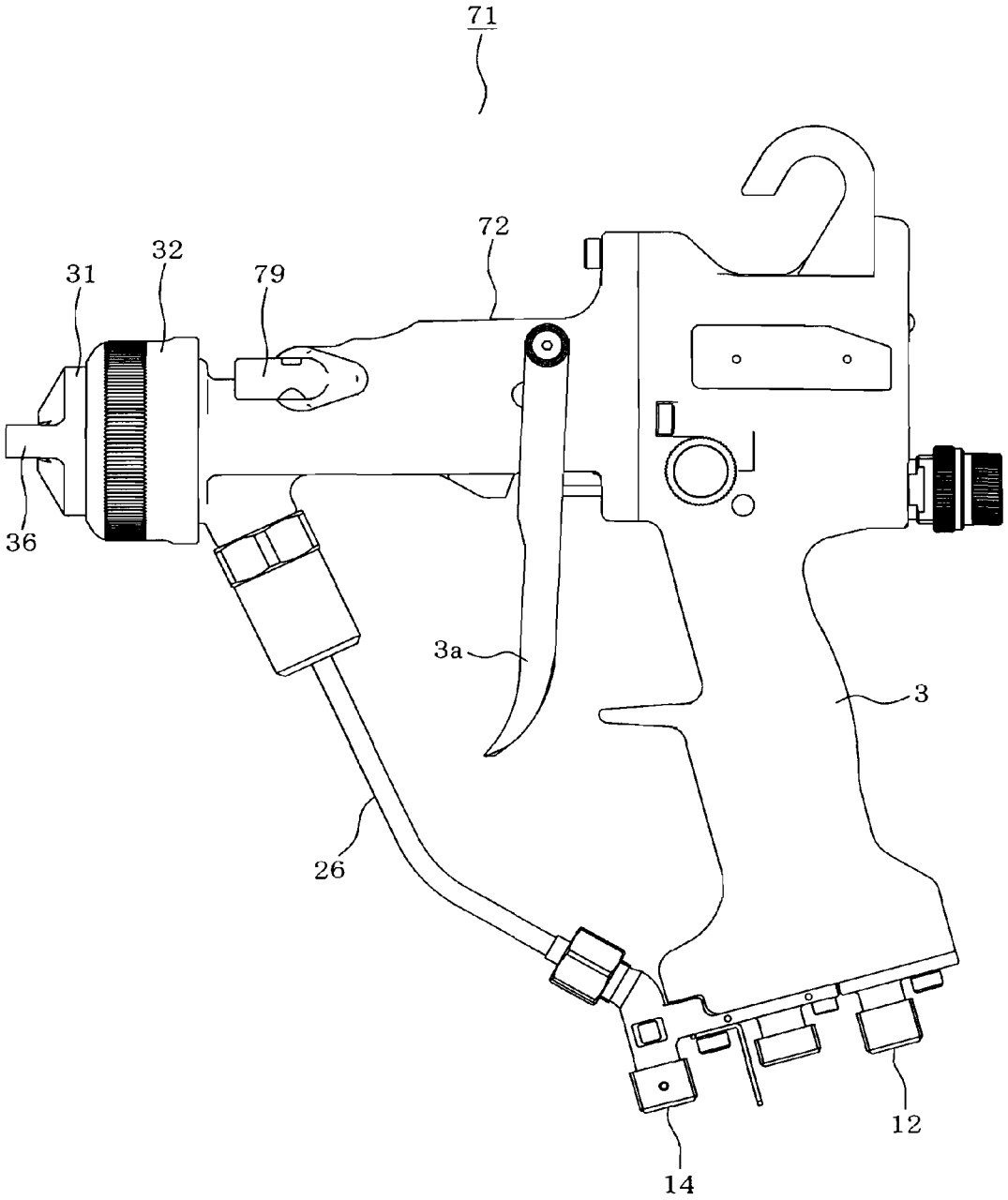
FIG. 12 is a left side view of the electrostatic spraying device.
Figure 13:
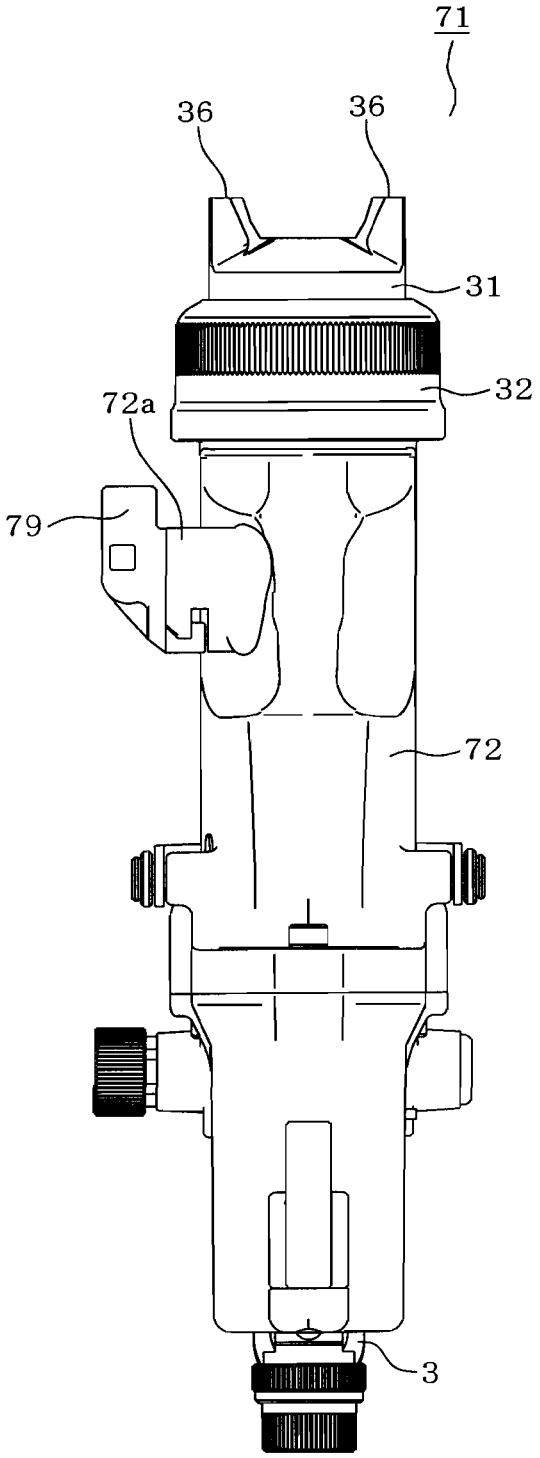
FIG. 13 is a plan view of the electrostatic spraying device.
Figure 14:
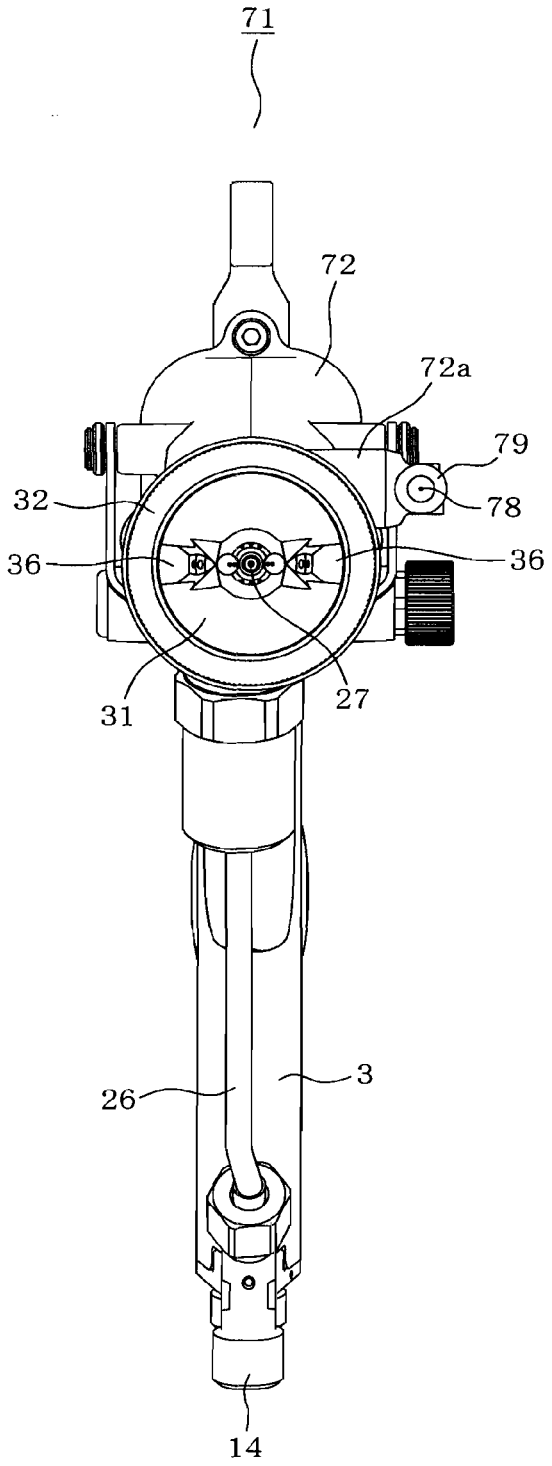
FIG. 14 is a front view of the electrostatic spraying device.
Figure 15:
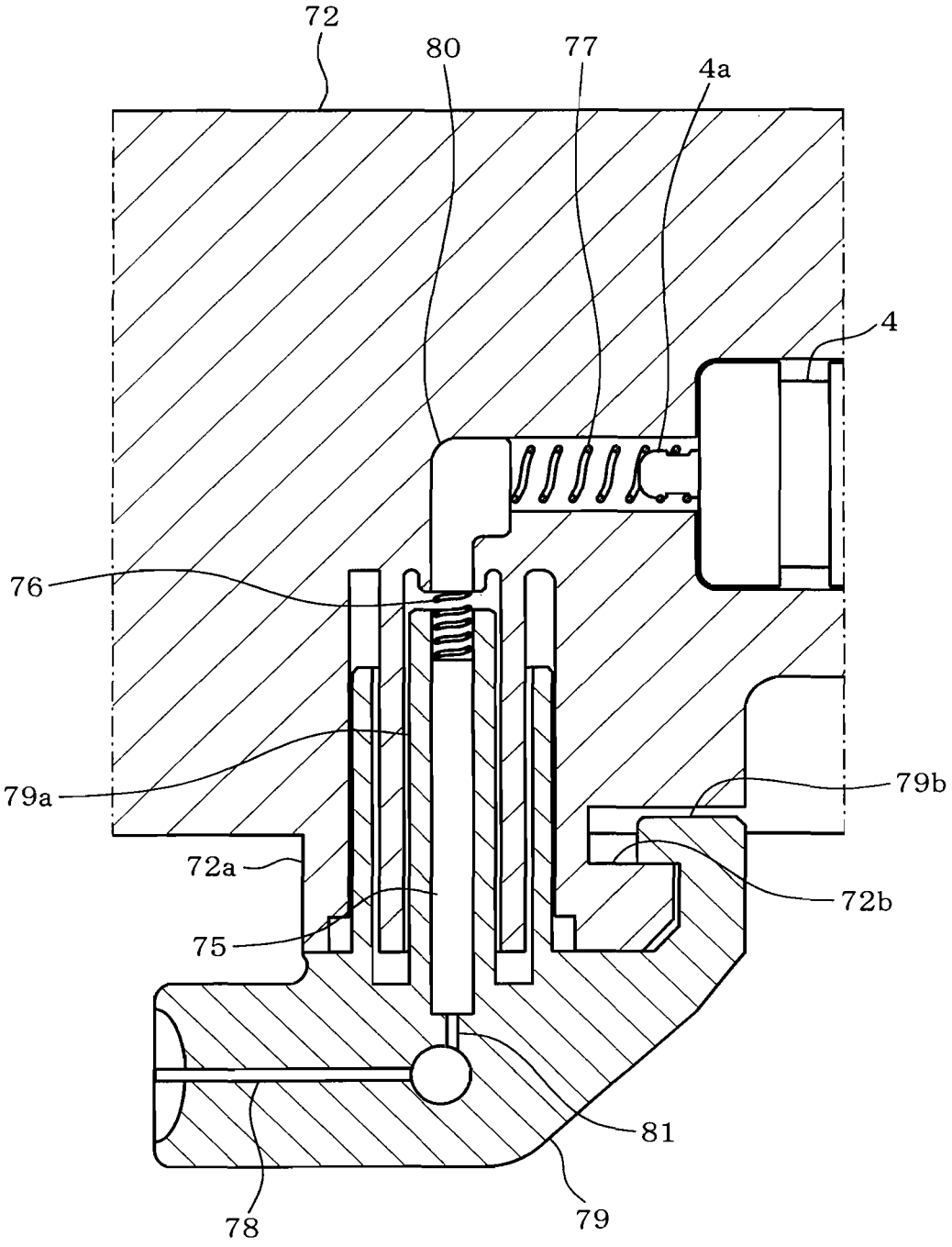
FIG. 15 is a sectional view showing a part where a resistor is mounted and its periphery.

FIG. 9 shows the relationship between distance L and the electric charge amount (μC/g) obtained by the experiment. The experiment confirms that an electric charge amount of sprayed paint particles is significantly increased when distance L is set in a range from 20 mm to 60 mm or more desirably in a range from 30 mm to 50 mm. Further, FIG. 10 shows the relationship between distance H and the electric charge amount (μC/g) obtained by the experiment. The experiment confirms that an electric charge amount of sprayed paint particles is significantly increased when distance H is set in a range from 20 mm to 50 mm.

According to the above-described embodiment, the electrostatic spraying device 1 is of the external charge type and includes the high-voltage electrode 8 to which high voltage is applied and which is provided on the outer periphery of the device body 2. The high-voltage electrode 8 is disposed at the position the predetermined distance backwardly away from the paint outlet 24 on the outer periphery of the device body 2, so as to be separated from the paint flow passage 23 thereby to be insulated from the paint flow passage 23. As a result, when carrying out spraying with the electrostatic spraying device 1, the user need not pay attention to prevent the electrode from contacting with an object to be painted, other devices or apparatuses, other personnel or the like, with the result that the operability of the electrostatic spraying device 1 can be improved. Further, since the high-voltage electrode 8 to which the high voltage is applied is located behind the paint outlet 24, an electric field is hard to form between the high-voltage electrode 8 and the object located ahead of the paint outlet 24. Accordingly, the paint sprayed out of the paint outlet 24 can intensively be charged by the high-voltage electrode 8, whereby the paint charging efficiency can be improved. Further, since the high-voltage electrode 8 is not located in the area into which the paint is sprayed from the paint outlet 24 (the area in front of the electrostatic spraying device 1), the paint sprayed from the paint outlet 24 is hard to adhere to the high-voltage electrode 8. Consequently, the high-voltage electrode 8 and accordingly an entire electrostatic spraying device 1 become hard to soil.

Further, the high-voltage electrode 8 is disposed at the position which is the predetermined distance radially outward away from the paint flow passage 23 with the central focus on the spray axis interconnecting the paint outlet 24 and the object to which the paint sprayed from the paint outlet 24 is caused to adhere, by the most direct way. As a result, the high-voltage electrode 8 can be provided on the side of the electrostatic spraying device 1 in a compact manner without reduction in the paint particle charging efficiency by the high voltage electrode 8. This can further improve the operability of the electrostatic spraying device 1 and the paint charging efficiency, and moreover, the high-voltage electrode 8 becomes harder to soil.

Further, the high-voltage electrode 8 is formed into the shape of a needle extending along the axial direction of the device body 2. Consequently, the high-voltage electrode 8 can be provided on the side of the electrostatic spraying device 1 in a further compact manner with the result that the operability of the electrostatic spraying device 1 and the paint charging efficiency can be further improved. Moreover, the high-voltage electrode 8 become hard to soil.

A second embodiment of the invention will be described. As shown in FIGS. 11 to 14, the electrostatic spraying device 71 of the second embodiment includes a high-voltage electrode mount 72*a* which is provided on a left side so as to protrude leftward with the distal end side being the front. A high-voltage supply system, an air supply system, a paint spraying system, an air spray system and the like are provided in the interior of the device body 72 in the same manner as in the first embodiment.

A resistor 75 which is an electrical conductor is inserted into the high-voltage electrode mount 72*a*. The resistor 75 serves as a constituent corresponding to the above-described conductor bar 5. The resistor 75 is not comprised of a mere metal member which can result in a function of the resistor but is provided as a constituent whose material and construction are intentionally designed so as to function as a resistor.

In this case, the resistor 75 is provided in a mounting shaft 79*a* of a high-voltage electrode case 79 in which the high-voltage electrode 78 is enclosed. The high-voltage electrode case 79 is detachably attached to the high-voltage electrode mount 72*a*, whereby the resistor 75 is enclosed in the high-voltage electrode mount 72*a*. More specifically, the resistor 75 is enclosed in the high-voltage electrode mount 72*a* indirectly through the high-voltage electrode case 79 but not directly in the high-voltage electrode mount 72*a*.

The high-voltage electrode case 79 has an engaging portion 79*b* formed integrally therewith. The high-voltage electrode mount 72*a* has an engaged portion 72*b* formed integrally therewith. When the mounting shaft 79*a* is inserted into the high-voltage electrode mount 72*a*, and the high-voltage electrode case 79 is rotated about the mounting shaft 79*a*, the engaging portion 79*b* engages the engaged portion 72*b*. As a result, the high-voltage electrode case 79 is detachably attached to the high-voltage electrode mount 72*a*.

When the high-voltage electrode case 79 is attached to the high-voltage electrode mount 72*a*, the resistor 75 is connected physically and electrically to the output terminal 4*a* of the high-voltage generator 4 via springs 76 and 77 both made of an electrically conductive material and a holding member 80 holding the springs 76 and 77. The holding member 80 may be made of an electrically conductive material or of, for example, an insulating synthetic resin material when the springs 76 and 77 are brought into contact with each other in the interior of the holding member 80.

When enclosed in the high-voltage electrode mount 72*a*, the resistor 75 extends in a direction perpendicular to a longitudinal direction with respect to the device body 72, that is, a longitudinal direction with respect to the electrostatic spraying device 71 (a vertical direction). As a result, although the resistor 75 is interposed between the high-voltage generator 4 and the high-voltage electrode 78, the resistor 75 is prevented from extending in the longitudinal direction of the device body 72 and accordingly, the position of the high-voltage electrode 78 and particularly the position of the proximal end of the high-voltage electrode 78 can be set to be as far back as possible on the outer periphery of the device body 72 (a side area of the electrostatic spraying device 71). In this case, the position of the proximal end of the high-voltage electrode 78 corresponds with a position of the high-voltage electrode mount 72*a* provided on the side of the device body 72. Accordingly, the position of the high-voltage electrode 78 can be set at least to be behind the retaining nut 32 mounted on the distal end of the device body 72.

Further, the resistor 75 and the high-voltage electrode 78 extend in respective directions substantially perpendicular to each other in the high-voltage electrode case 79. More specifically, the high-voltage electrode 78 extends forward along the longitudinal direction of the electrostatic spraying device 71 from the distal end of the resistor 75 which is perpendicular to the longitudinal direction of the electrostatic spraying device 71. The distal end of the resistor 75 and the proximal end of the high-voltage electrode 78 are connected via an electrically conductive connecting member 81 to each other in the high-voltage electrode case 79. The high-voltage electrode 78 has a distal end formed into a pin shape and a proximal end formed into a spherical shape. The spherical proximal end of the high-voltage electrode 78 is in contact with a distal end of the connecting member 81, whereby the high-voltage electrode 78 is connected via the connecting member 81 to the distal end of the resistor 75.

Figure 16:
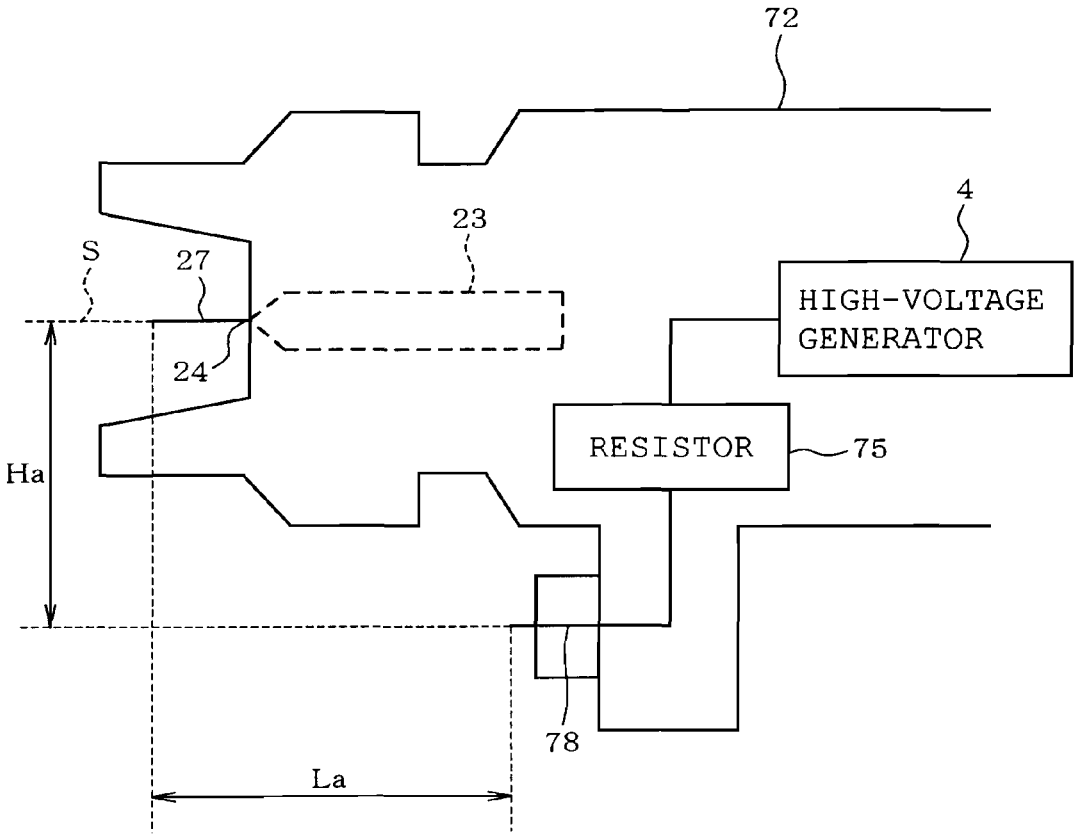
FIG. 16 is a view similar to FIG. 7.

The high-voltage electrode 78 is provided on the outer periphery of the device body 72, more specifically, on the right side (right side area) of the electrostatic spraying device 71 as shown in FIG. 16. In this case, the distal end of the high-voltage electrode 78 is located a predetermined distance La backwardly away from the distal end of the ground electrode 27 protruding from the paint outlet 24. The high-voltage electrode 78 extends forward from the high-voltage electrode mount 72*a* to the position spaced a predetermined distance La backwardly away from the distal end of the ground electrode 27 on the outer periphery of the device body 72, but the high-voltage electrode 27 does not extend further. More specifically, the distal end of the high-voltage electrode 78 does not protrude forward beyond the distal end of the ground electrode 27 and the distal end of the entire electrostatic spraying device 71 (the distal ends of the protrusions 36, in this case).

The high-voltage electrode 78 is located in the side region of the electrostatic spraying device 71 in its entirety, and an entire or a part of the high-voltage electrode 78 is not located in a region in front of the electrostatic spraying device 71. Further, the high-voltage electrode 78 disposed on an outer periphery of the device body 72 extends forward or in a spraying direction of the paint and has a distal end which does not protrude ahead of the distal end of the ground electrode 27 and further ahead of the distal end of the electrostatic spraying device 71. More specifically, the high-voltage electrode 78 is shorter than the device body 72 in an entire length and is located in the side region of the electrostatic spraying device 71 in its entirety.

Further, the high-voltage electrode 78 is covered, in its entirety, with the high-voltage electrode case 79 made of the insulating material. Moreover, the connecting member 81 and the resistor 75 both electrically connected to the high-voltage electrode 78 are also covered with the high-voltage electrode case 79. Further, the springs 76 and 77 and the holding member 80 all electrically connected to the resistor 75 are covered with the device body 72 made of the insulating material. Accordingly, the high-voltage electrode 78 is disposed separately from the paint flow passage 23 in the device body 72 so as to be electrically insulated from the paint flow passage 23. Further, the high-voltage electrode 78 is disposed at a position which is a predetermined distance Ha radially outward away from the paint flow passage 23 with a central focus on the spray axis S. More specifically, the high-voltage electrode 78 is separated from the spray axis S with the insulating member being interposed therebetween and is further separated from a side of the device body 72, in other words, a side of the electrostatic spraying device 71 with the insulating member being interposed therebetween.

According to the above-described electrostatic spraying device 71, the resistor 75 is disposed so as to extend in the direction perpendicular to the longitudinal direction of the device body 72 although the resistor 75 is disposed in the high-voltage supply system between the high-voltage generator 4 and the high-voltage electrode 78. As a result, the resistor 75 requires no mounting space along the longitudinal direction of the device body 72. Accordingly, the mounting position of the high-voltage electrode 78 can be set to be as far back as possible on the outer periphery of the device body 72. More specifically, the mounting position of the high-voltage electrode 78 need not be moved forward with the mounting of the resistor 75, and the entire high-voltage electrode 78 can be located in the side region of the electrostatic spraying device 71 while the resistor 75 is mounted.

Further, the resistor 75 constituting a part of the high-voltage supply system is disposed to extend in the direction perpendicular to the longitudinal direction of the electrostatic spraying device 71. As a result, the length (the mounting space) of the resistor 75 need not be taken into consideration with respect to the longitudinal direction of the electrostatic spraying device 71, whereby the length of the high-voltage supply system can be rendered as short as possible with respect to the longitudinal direction of the electrostatic spraying device 71. More specifically, a part of the length of the high-voltage supply system (at least the length of the resistor 75) is dispersed in the direction perpendicular to the longitudinal direction of the electrostatic spraying device 71. According to this construction, the distal end of the high-voltage supply system, that is, the position of the distal end of the high-voltage electrode 78 can be located as far back as possible in the side region without protruding ahead of the electrostatic spraying device 71.

In the electrostatic spraying device 1 of the first embodiment, too, the conductor bar 5 serving as the conductor is disposed to extend in the direction perpendicular to the longitudinal direction of the device body 2. Accordingly, the entire high-voltage electrode 8 can be located in the side region of the electrostatic spraying device 1 while the conductor bar 5 is installed. Further, the length of the high-voltage supply system in the longitudinal direction of the electrostatic spraying device 1 can be rendered as short as possible, and the distal end of the high-voltage supply system, that is, the position of the distal end of the high-voltage electrode 8 can be located as far back as possible in the side region without protruding ahead of the electrostatic spraying device 1.

Further, since the electrostatic spraying device 71 is provided with the resistor 75 serving as the conductor, the resistor 75 functions as a limiting resistor and can prevent an excessively high voltage from being applied to the high-voltage electrode 78 and an excessively large current from flowing into the high-voltage electrode 78. Additionally, the conductor bar 5 in the first embodiment can also perform the function of the limiting resistor though not to the extent of the resistor 75. Accordingly, the conductor bar 5 can also function as a protection means which prevents an excessively high voltage from being applied to the high-voltage electrode 78 and an excessively large current from flowing into the high-voltage electrode 8.

Further, the resistor 75 is provided in the high-voltage electrode case 79 detachably attachable to the device body 72 but not at the device body 72 side. Accordingly, even if the resistor 75 should be broken, the high-voltage electrode case 79 including the broken resistor 75 would be replaced by a high-voltage electrode case 79 including a new resistor 75. Consequently, even when the resistor 75 is broken, the device body 72 or the entire electrostatic spraying device 71 need not be replaced by a new one. Further, the resistor 75 can be treated as a replaceable expendable item but not as an irreplaceable component.

Further, since the high-voltage electrode 78 is located on the side of the device body 72, the high-voltage electrode 78 and the high-voltage electrode case 79 need not be detached, attached or moved when the distal air cap 31 and the paint nozzle 22 are attached or detached. Accordingly, an assembly efficiency and maintainability of the electrostatic spraying device 71 can be improved. Further, the above-described location of the high-voltage electrode 78 can reduce breakage and/or wear of the high-voltage electrode 78 and the high-voltage electrode case 79 and of a contact portion between the high-voltage electrode case 79 and the high-voltage electrode mount 72*a*.

The high-voltage electrode 78 and the high-voltage electrode case 79 do not protrude ahead of the distal end of the electrostatic spraying device 71. Accordingly, even if the electrostatic spraying device 71 should drop onto the floor or the like such that the high-voltage electrode 78 and the high-voltage electrode case 79 would come into contact with the floor or the like, moment acting on the high-voltage electrode 78 and the high-voltage electrode case 79 can be rendered as small as possible. This can provide the electrostatic spraying device 71 in which the high-voltage electrode 78 and the high-voltage electrode case 79 are hard to break. Additionally, the first embodiment can also achieve the same effect as described above regarding the second embodiment since the high-voltage electrode 8 and the high-voltage electrode case 9 do not protrude ahead of the distal end of the electrostatic spraying device 1 in the first embodiment.

The invention should not be limited to the foregoing embodiments but may be modified or expanded as follows.

Figure 17:
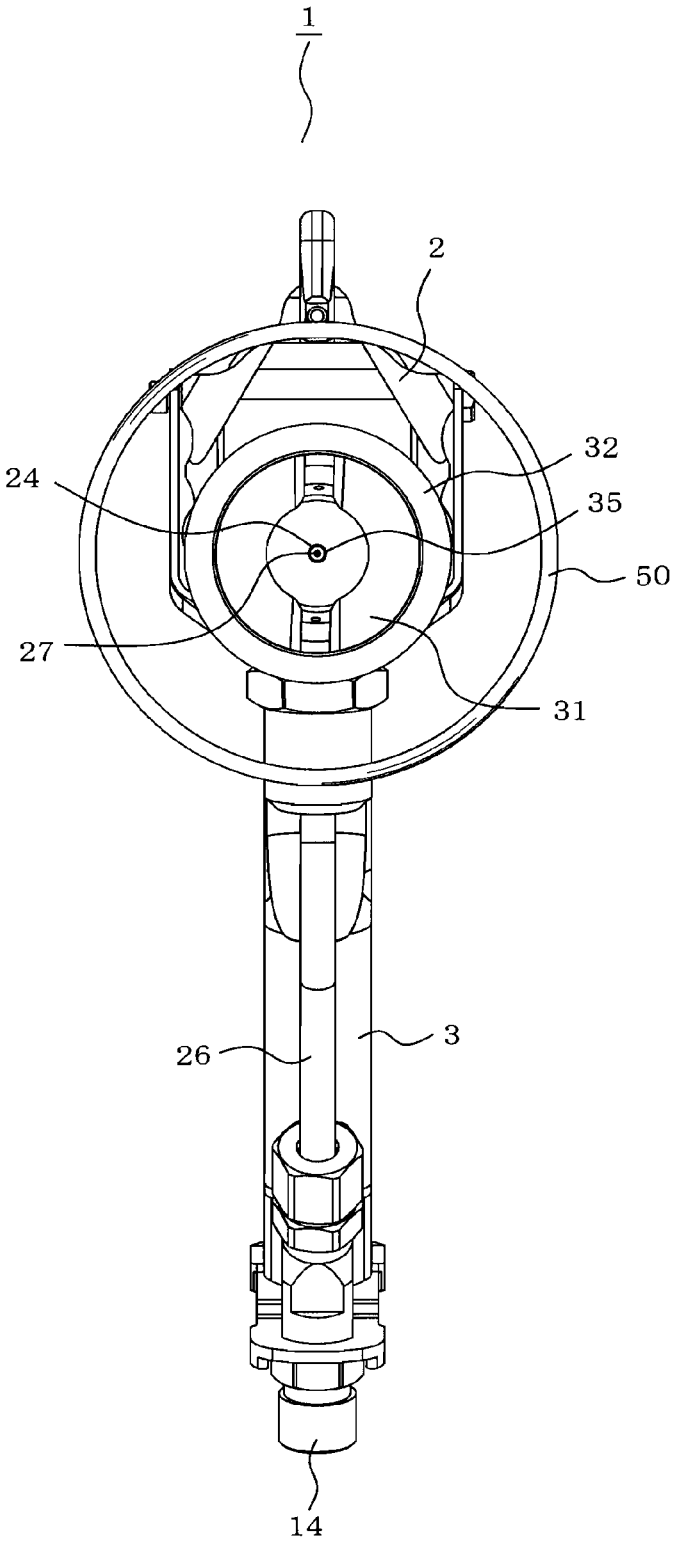
FIG. 17 is a view similar to FIG. 4, showing a modified form.

The electrostatic spraying device 1 may include a high-voltage electrode 50 formed into an annular shape with a central focus on the axis of the device body 2, that is, the paint spray axis S, instead of the needle-shaped high-voltage electrode 8, as shown in FIG. 17. In this case, the high-voltage electrode 50 may be formed into a toric, elliptical annular or polygonal annular shape. The high-voltage electrode 50 may have a circular or rectangular section. Additionally, the construction as shown in FIG. 17 may be applied to the electrostatic spraying device 71.

Figure 18:
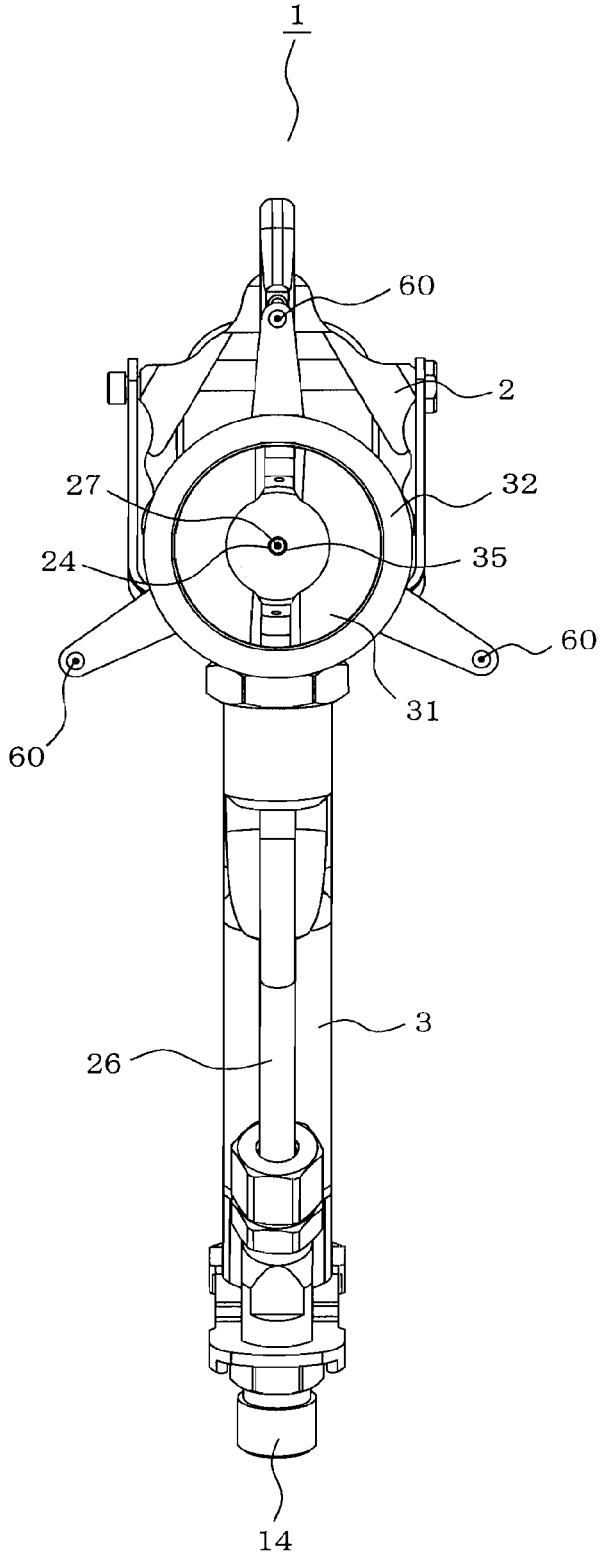
FIG. 18 is also a view similar to FIG. 4, showing another modified form.

The electrostatic spraying device 1 may have a plurality of, in this case, three, high-voltage electrodes 60 which are disposed circumferentially at regular intervals on the outer periphery of the device body 2, as shown in FIG. 18. The number of the high-voltage electrodes 60 may be changeable. The high-voltage electrodes 60 may be unequally spaced circumferentially with respect to the device body 2. The construction as shown in FIG. 18 may also be applied to the electrostatic spraying device 71.

The invention should not be limited to the handheld electrostatic spraying device 1 or 71 in which the user holds the grip 3 and may be applied to electrostatic spraying devices having no holding portions respectively. More specifically, for example, the invention may be applied to an electrostatic spray nozzle directly mounted to a nozzle mount of a pressure feed painting apparatus (not shown).

The high voltage generator 4 may be configured to generate a positive high voltage. The paint tube 26 may stretch into a spiral or linear shape depending upon a type of paint to be used. The foregoing embodiments may be combined together in practice.

The invention may be applied to an electrostatic spraying device in which pattern air is not sprayed. Thus, the invention may be applied to various types of electrostatic spraying devices which cause electrically charged paint to adhere to the object.

The invention claimed is:

1. An electrostatic spraying device comprising:

a device body having a paint supply passage connected to a paint supply source;

a paint nozzle provided on a distal end of device body and having a paint flow passage communicating with the paint supply passage and a paint outlet formed through a distal end of the paint flow passage;

a high-voltage generating part configured to generate high voltage with which paint sprayed from the paint outlet is charged;

a high-voltage electrode to which the high voltage generated by the high voltage generating part is applied, wherein the high-voltage electrode is disposed at a position a predetermined distance backwardly away from the paint outlet on an outer periphery of the device body, so as to be separated from the paint flow passage and thereby to be insulated from the paint flow passage;

a conductor provided between the high-voltage generating part and the high-voltage electrode;

a spring provided between the high-voltage electrode and the conductor;

a high-voltage electrode case detachably attached to the device body to enclose the high-voltage electrode; and a grip provided on an end of the device body, which end is located opposite the paint nozzle.

2. The electrostatic spraying device according to claim 1, wherein the high-voltage electrode is disposed at a position which is a predetermined distance radially outward away from the paint flow passage with a central focus on a spray axis connecting between the paint outlet and an object to which the paint sprayed from the paint outlet is caused to adhere, by a most direct way.

3. The electrostatic spraying device according to claim 1, wherein the conductor extends in a direction perpendicular to a longitudinal direction of the device body.

4. The electrostatic spraying device according to claim 1, wherein the conductor comprises a resistor.

5. The electrostatic spraying device according to claim 2, wherein the conductor comprises a resistor.

6. The electrostatic spraying device according to claim 5, wherein the conductor comprises a resistor.

7. The electrostatic spraying device according to claim 1, wherein the high-voltage electrode is formed into needle shape extending along an axial direction of the device body or an annular shape with a central focus on an axis of the device body.

8. The electrostatic spraying device according to claim 2, wherein the high-voltage electrode is formed into needle shape extending along an axial direction of the device body or an annular shape with a central focus on an axis of the device body.

9. The electrostatic spraying device according to claim 4, wherein the high-voltage electrode is formed into needle shape extending along an axial direction of the device body or an annular shape with a central focus on an axis of the device body.

10. The electrostatic spraying device according to claim 5, wherein the high-voltage electrode is formed into needle shape extending along an axial direction of the device body or an annular shape with a central focus on an axis of the device body.

11. The electrostatic spraying device according to claim 3, wherein the high-voltage electrode is formed into needle shape extending along an axial direction of the device body or an annular shape with a central focus on an axis of the device body.

12. The electrostatic spraying device according to claim 1, wherein a plurality of the high-voltage electrodes is disposed at regular intervals on the outer periphery of the device body.

13. The electrostatic spraying device according to claim 2, wherein a plurality of the high-voltage electrodes is disposed at regular intervals on the outer periphery of the device body.

14. The electrostatic spraying device according to claim 3, wherein a plurality of the high-voltage electrodes is disposed at regular intervals on the outer periphery of the device body.

15. The electrostatic spraying device according to claim 4, wherein a plurality of the high-voltage electrodes is disposed at regular intervals on the outer periphery of the device body.

16. The electrostatic spraying device according to claim 5, wherein a plurality of the high-voltage electrodes is disposed at regular intervals on the outer periphery of the device body.

17. The electrostatic spraying device according to claim 6, wherein a plurality of the high-voltage electrodes is disposed at regular intervals on the outer periphery of the device body.

18. The electrostatic spraying device according to claim 7, wherein a plurality of the high-voltage electrodes is disposed at regular intervals on the outer periphery of the device body.

19. The electrostatic spraying device according to claim 8, wherein a plurality of the high-voltage electrodes is disposed at regular intervals on the outer periphery of the device body.

20. The electrostatic spraying device according to claim 9, wherein a plurality of the high-voltage electrodes is disposed at regular intervals on the outer periphery of the device body.

21. The electrostatic spraying device according to claim 10, wherein a plurality of the high-voltage electrodes is disposed at regular intervals on the outer periphery of the device body.

22. The electrostatic spraying device according to claim 11, wherein a plurality of the high-voltage electrodes is disposed at regular intervals on the outer periphery of the device body.

23. The electrostatic spraying device according to claim 6, wherein the high-voltage electrode is formed into needle shape extending along an axial direction of the device body or an annular shape with a central focus on an axis of the device body.

* * * * *